US008490888B2

(12) United States Patent
Greeves et al.

(10) Patent No.: US 8,490,888 B2
(45) Date of Patent: Jul. 23, 2013

(54) FUEL INJECTOR

(75) Inventors: Godfrey Greeves, Middlesex (GB); Simon David Tullis, Gillingham (GB)

(73) Assignee: Delphi Technologies Holding S.arl, Luxembourg (LU)

( * ) Notice: Subject to any disclaimer, the term of this patent is extended or adjusted under 35 U.S.C. 154(b) by 315 days.

(21) Appl. No.: 12/937,283

(22) PCT Filed: Mar. 30, 2009

(86) PCT No.: PCT/GB2009/050306

§ 371 (c)(1), (2), (4) Date: Nov. 4, 2010

(87) PCT Pub. No.: WO2009/127850

PCT Pub. Date: Oct. 22, 2009

(65) Prior Publication Data

US 2011/0186648 A1 Aug. 4, 2011

(30) Foreign Application Priority Data

Apr. 14, 2008 (GB) ..... 0806705.0

(51) Int. Cl.

| | |
|---|---|
| ***F02M 61/10*** | (2006.01) |
| ***F02M 61/04*** | (2006.01) |
| ***F02M 61/18*** | (2006.01) |
| ***F02M 61/00*** | (2006.01) |

(52) U.S. Cl.

USPC .... 239/5; 239/533.2; 239/533.4; 239/533.11; 239/533.12

(58) Field of Classification Search

USPC ..... 239/5, 88, 96, 533.2–533.4, 533.8, 239/533.9, 533.11, 533.12; 123/294, 299, 123/305

See application file for complete search history.

(56) References Cited

U.S. PATENT DOCUMENTS

| | | | | |
|---|---|---|---|---|
| 6,758,407 | B1 | 7/2004 | Lambert et al. | |
| 6,896,208 | B2 * | 5/2005 | Kuegler | 239/533.4 |
| 2006/0032948 | A1 | 2/2006 | Smout et al. | |
| 2006/0060675 | A1 | 3/2006 | Cooke et al. | |
| 2007/0006842 | A1 | 1/2007 | Kesse et al. | |

FOREIGN PATENT DOCUMENTS

| | | |
|---|---|---|
| EP | 1 059 437 | 12/2000 |
| EP | 1 626 173 | 2/2006 |
| EP | 1 637 730 | 3/2006 |
| EP | 1 719 903 | 11/2006 |

(Continued)

OTHER PUBLICATIONS

International Search Report dated Jul. 29, 2009.
Japan Office Action dated Jul. 5, 2012.
European Search Report dated Mar. 16, 2012.
English Translated 2nd Japan Office Action dated Apr. 23, 2013.

*Primary Examiner* — Darren W Gorman
(74) *Attorney, Agent, or Firm* — Mark H. Svoboda

(57) ABSTRACT

A fuel injector for delivering fuel to a combustion chamber having a chamber ceiling, the fuel injector having a primary axis and able to control fuel delivery through a first outlet opening or together through both the first outlet opening and a second outlet opening. The first and second outlet openings are oriented such that, in use, when fuel delivery is permitted through only the first outlet opening, a first spray formation reaches a first target distance below the chamber ceiling at a radial distance from the primary axis. When fuel delivery is permitted through both openings together, respective first and second spray formations merge externally of the injector so as to give rise to a combined spray formation reaching second target distance below the chamber ceiling at the radial distance from the primary nozzle axis, wherein the second target distance is larger than the first target distance.

19 Claims, 4 Drawing Sheets

FOREIGN PATENT DOCUMENTS

| | | |
|---|---|---|
| FR | 2 895 025 | 6/2007 |
| JP | 63-112270 | 7/1988 |
| JP | 8 254123 | 10/1996 |
| JP | 2007-218175 | 8/2007 |

* cited by examiner

FUEL INJECTOR

TECHNICAL FIELD

The present invention relates to a fuel injector mountable with respect to a combustion chamber for delivering fuel thereto, and to a fuel injection system for an internal combustion engine comprising such an injector.

BACKGROUND TO THE INVENTION

Fuel injectors are used to deliver fuel under high pressure to a combustion space of an engine. It is known to use multi-hole fuel injection nozzles in internal combustion engines, such as diesel engines with direct injection diesel combustion systems. One such multi-hole fuel injection nozzle is disclosed in European Patent No. 1626173 and comprises a nozzle body having concentric valve needles to control the flow of fuel through respective upper and lower spray holes.

Due to increasingly stringent engine emissions regulations, it is highly desirable to reduce diesel engine exhaust soot emission by optimising the mixing of air and fuel within the engine combustion chamber. To this end, European Patent No. 1059437 describes a multi-hole injection nozzle which provides improved optimisation of air/fuel mixing. FIG. 1 shows an injection nozzle of the kind described in EP-1059437.

Referring to FIG. 1, the injection nozzle comprises a nozzle body 1 having a blind bore 2. The nozzle body 1 defines a primary nozzle axis A-A which is co-axial with the blind bore 2. The blind end of the bore 2 is provided with upper and lower spray holes 3, 4 and defines a seating with which a valve needle (not shown) is engageable to control the supply of fuel to the upper and lower spray holes 3, 4. The valve needle may be of the type described in EP-1626173, where inner and outer concentric valve needles are provided to control the flow of fuel through both the upper and lower spray holes together or through the upper spray hole only.

When fuel flows through both the upper and lower spray holes 3, 4 together, first and second fuel sprays are emitted having axes labelled 7 and 8, respectively. The first and second fuel sprays 7, 8 merge to form a single fuel spray jet which gives the effect of a single large spray hole in terms of fuel mass flow and penetration of the fuel spray jet.

The intersection point 6 of the first and second fuel sprays 7, 8 lies a distance RC into the combustion chamber, in a direction perpendicular to the primary nozzle axis A-A. The line 9 defines the axis and direction of the merged fuel spray jet. The vertical distance X3 below the flame face 10 of the engine cylinder head (i.e. at the ceiling of the combustion chamber) at the radius RC from the centre of the combustion chamber gives a vertical target direction of the merged fuel jet.

At high engine loads and speeds with injection from both spray holes 3, 4, the vertical target of the merged fuel spray jet 9 corresponds to the distance X3 below the flame face 10 of the engine cylinder head at the radius RC from the centre of the combustion chamber.

At low loads and speeds, with injection from only the upper spray hole 3, the vertical target of the fuel spray jet from the single spray hole also corresponds to the distance X3 below the flame face 10 at the radius RC from the centre of the combustion chamber.

In the case that the injection nozzle of FIG. 1 is provided with a valve needle which is operable, at low engine speeds and loads, to inject fuel through only the lower spray hole 4, the vertical target of the fuel spray jet from the single spray hole also corresponds to the distance X3 below the flame face 10 at the radius RC from the centre of the combustion chamber.

Accordingly, with the conventional injection nozzle of FIG. 1, regardless of whether fuel is injected through only one of the spray holes 3, 4 or through both of them together, the vertical target distance of the resulting fuel spray jet is the same. This is problematic for obtaining the lowest possible soot emissions because the vertical target distance which is optimal for air/fuel mixing is known to vary as a function of the engine speed/load.

It is an object of the present invention to provide a fuel injection nozzle which substantially overcomes or mitigates the aforementioned problem.

SUMMARY OF INVENTION

According to a first aspect of the present invention, there is provided a fuel injector mountable with respect to a combustion chamber for delivering fuel thereto, the combustion chamber comprising a chamber ceiling and a chamber wall, the fuel injector comprising:

a nozzle body having a primary nozzle axis;

a first outlet opening having a first axis;

a second outlet opening having a second axis; and means for controlling fuel delivery through the first and second outlet openings, said means comprising an inner valve needle and an outer valve needle, and being arranged to permit fuel delivery from only the first outlet opening, or through both the first and second outlet openings together;

wherein the first and second outlet openings are oriented such that, in use, when fuel delivery is permitted through only said first outlet opening, a first spray formation is injected along the first axis, the first spray formation reaching a first target distance below said chamber ceiling at a radial distance from the primary nozzle axis; and when fuel delivery is permitted through both openings together, respective first and second spray formations are injected along the respective first and second axes to merge externally of the injector so as to give rise to a combined spray formation having a third axis, the combined spray formation reaching a second target distance below said chamber ceiling at said radial distance from the primary nozzle axis, and being substantially equivalent to a spray formation delivered as if from a single outlet opening having a diameter greater than that of the first outlet opening, wherein said first target distance is less than said second target distance.

Thus, the present invention provides a fuel injector which can give a different vertical fuel jet target at high engine loads and speeds compared with low engine loads and speeds and which can provide the combined benefit of varying the effective target direction with a variable effective spray hole diameter for the fuel spray jets. By providing a different vertical spray/jet target, a better optimization of the vertical distribution of the fuel in the combustion chamber can be obtained, while the variable effective spray hole diameter gives a better optimization of the fuel distribution in the radial direction in the combustion chamber as engine load and speed conditions are varied. In particular, when fuel delivery is permitted through only the first outlet opening, which may correspond to a low engine load/speed condition, the resulting first spray formation reaches the first target distance below the chamber ceiling, which may be the optimum target distance for minimising emissions at the low engine load/speed condition. The second target distance is larger than the first target distance and may be the optimum target distance for minimising emissions at a high engine load/speed condition, when fuel delivery is permitted through both first and second outlet openings. Furthermore, the delivery of fuel through the first and second outlet openings is conveniently controlled by inner and outer valve needles.

Preferably, the nozzle body comprises a blind bore, and the first and second outlet openings open into the blind bore at respective locations spaced apart in the direction of the primary nozzle axis.

Advantageously, the blind bore defines a seating with which each of the inner and outer valve needles is engageable.

The second outlet opening may conveniently be disposed between the first outlet opening and the blind end of the bore. Preferably, said outer valve needle is slidable within the bore to control fuel delivery through the first outlet opening and said inner valve needle is slidable within a further bore formed in the outer valve needle to control fuel delivery through the second outlet opening. More preferably, the fuel injector comprises load transmitting means to permit the outer valve needle to transmit a force to the inner valve needle so as to cause movement of the inner valve needle when the outer valve needle is moved beyond a predetermined amount.

Alternatively, the first outlet opening may be disposed between the second outlet opening and the blind end of the bore. In this case, said first and second axes may intersect at an intersection point which lies between the fuel injector and the chamber wall. Preferably, said outer valve needle is slidable within the bore to control fuel delivery through the second outlet opening and said inner valve needle is slidable within a further bore formed in the outer valve needle to control fuel delivery through the first outlet opening. More preferably, the fuel injector comprises load transmitting means to permit the inner valve needle to transmit a force to the outer valve needle so as to cause movement of the outer valve needle when the inner valve needle is moved beyond a predetermined amount.

Preferably, the fuel injector comprises one or more additional adjacent pairs of first and second outlet openings. More preferably, each of said adjacent pairs of first and second outlet openings are radially spaced at regular intervals around the primary nozzle axis.

Conveniently, said radial distance is substantially equal to the radius of the combustion chamber.

Preferably, said first outlet opening and said second outlet opening have substantially the same diameter.

According to a second aspect of the present invention, there is provided a fuel injection system for an internal combustion engine, the fuel injection system comprising a combustion chamber having a chamber ceiling and a chamber wall, and a fuel injector according to the first aspect for delivering fuel to the combustion chamber.

Preferred and/or optional features of the first aspect of the invention may be incorporated within the fuel injector of the second aspect, alone or in appropriate combination.

Figure 2A:
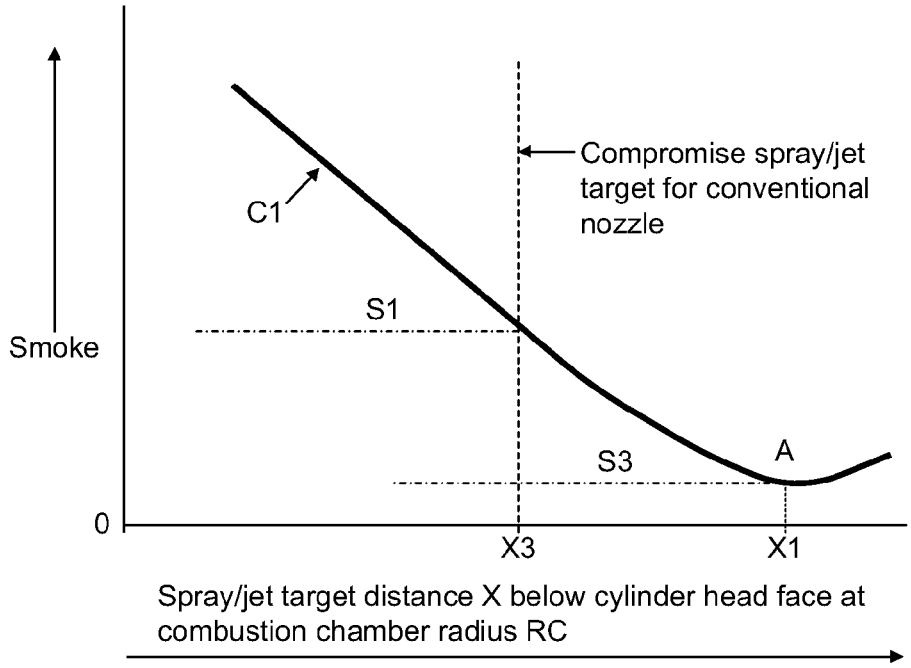
Figure 2B:
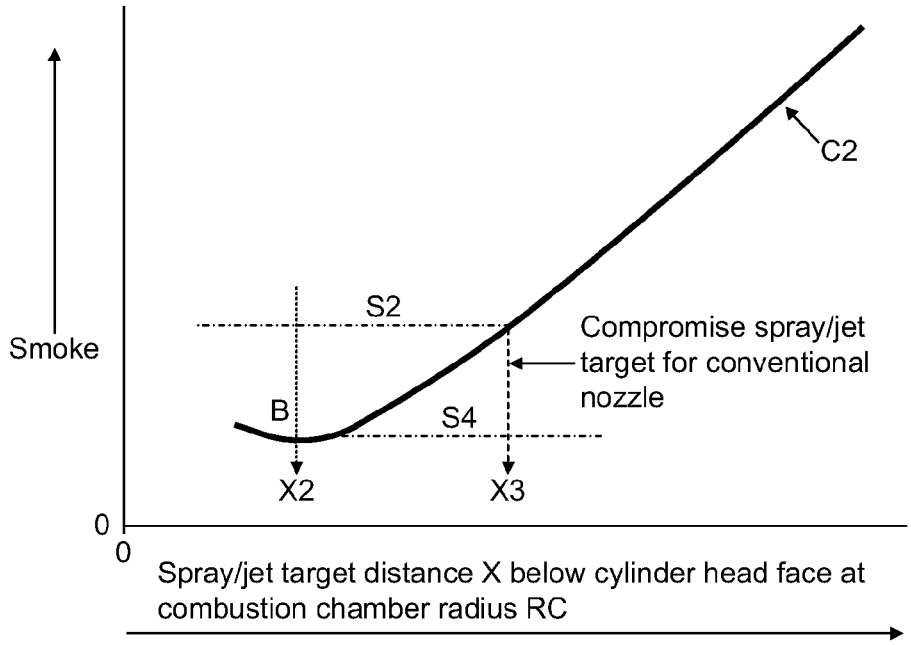
Figure 3:
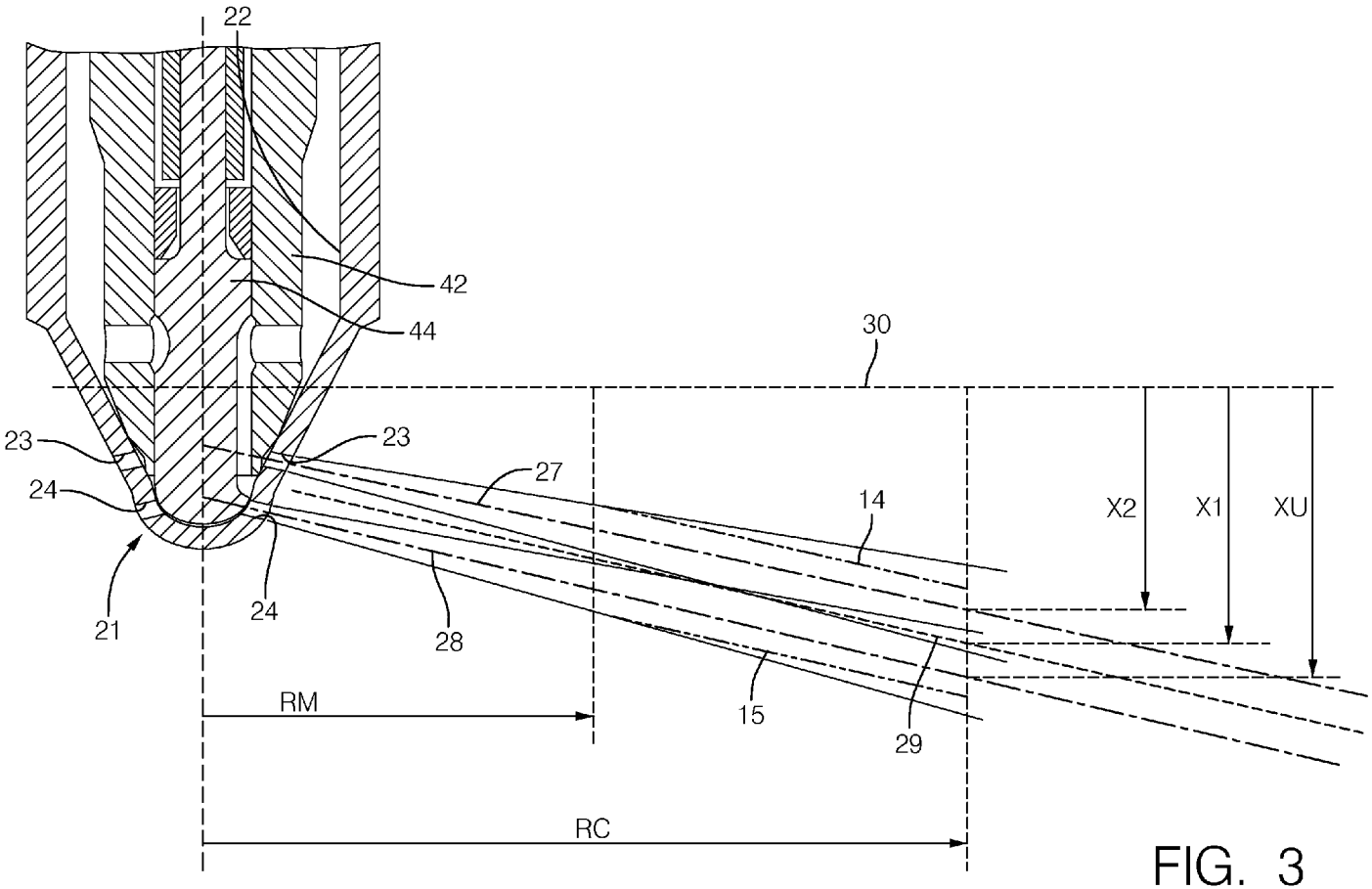
Figure 4:
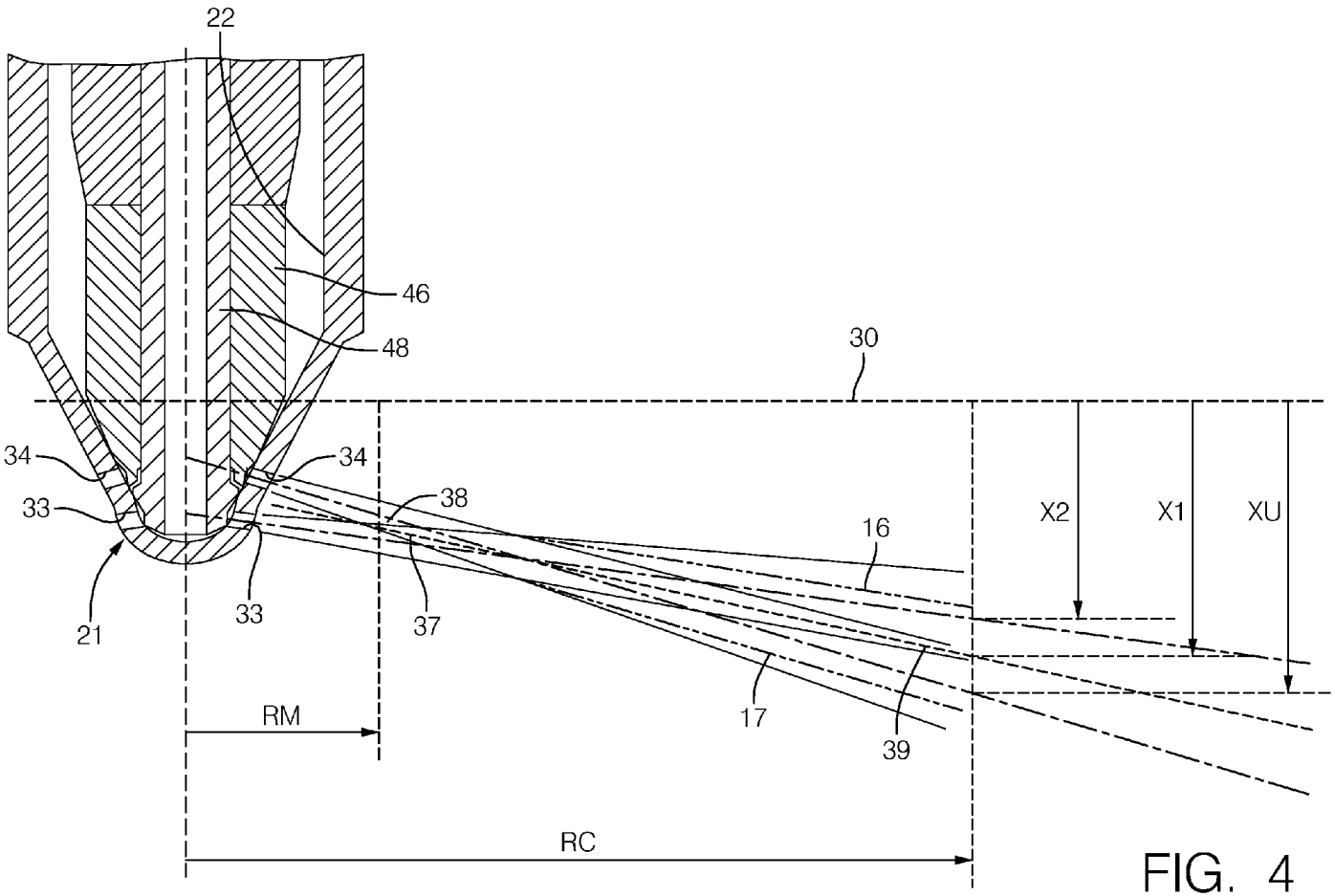

Embodiments of the present invention will now be described, by way of example only, with reference to FIGS. 2A to 4 of the accompanying drawings, in which;

FIG. 2A is a graph showing the relationship between engine soot emissions and fuel spray jet target distance under high engine load and speed conditions;

FIG. 2B is a graph showing the relationship between engine soot emissions and fuel spray jet target distance under low engine load and speed conditions;

FIG. 3 shows a first embodiment of an injection nozzle according to the present invention; and FIG. 4 shows a second embodiment of an injection nozzle according to the present invention.

DETAILED DESCRIPTION OF PREFERRED EMBODIMENTS

A combustion chamber of an internal combustion chamber is typically defined within an engine cylinder. A piston is mounted for reciprocable movement within the engine cylinder and comprises a piston bowl formed in an upper surface thereof. The ceiling of the combustion chamber is defined by a cylinder head face, which is also known in the art as a flame face. When installed within the engine, the injection nozzle of a fuel injector extends through an opening formed within the chamber ceiling. The wall of the combustion chamber which the fuel spray jet from the injection nozzle is incident upon is defined by the surface of the piston bowl of the piston. Typically, injection occurs when the piston is positioned at top dead centre (TDC) as is known in the art.

It will be appreciated by those skilled in the art that when liquid fuel is sprayed into the combustion chamber it will be vaporised due to the high temperature in the combustion chamber. Accordingly, the term spray jet or spray formation used hereinbelow will be understood to refer to the fuel injected through the fuel injection nozzle regardless of whether it is in vapour or liquid form, or a combination of both vapour and liquid.

Referring to FIGS. 2A and 2B, the soot emission from a diesel engine is sensitive to the vertical target of the fuel spray/jet on the wall of the combustion chamber in the piston bowl. Furthermore, engine emission test work shows that there is an optimum vertical distribution for injection of fuel into the combustion chamber for the best fuel/air mixing and, accordingly, the lowest soot or smoke emission.

FIGS. 2A and 2B comprise two curves C1, C2 of exhaust smoke levels on the vertical axis plotted versus a fuel spray jet target distance on the horizontal axis. The fuel spray jet target distance is the vertical distance X below the cylinder head face at a radius RC from the primary nozzle axis A-A in FIG. 1, such as the value X3. The curve C1 in FIG. 2A corresponds to a high engine load and high speed operating condition. It is apparent from curve C1 that the lowest smoke emission level S3 is achieved with a fuel spray jet target distance X1 below the cylinder head face or flame face. The curve C2 in FIG. 2B corresponds to a low engine load and low speed operating condition. It is apparent from curve C2 that the lowest smoke emission level S4 is achieved with a fuel spray jet target distance X2 below the cylinder head face.

Figure 1:
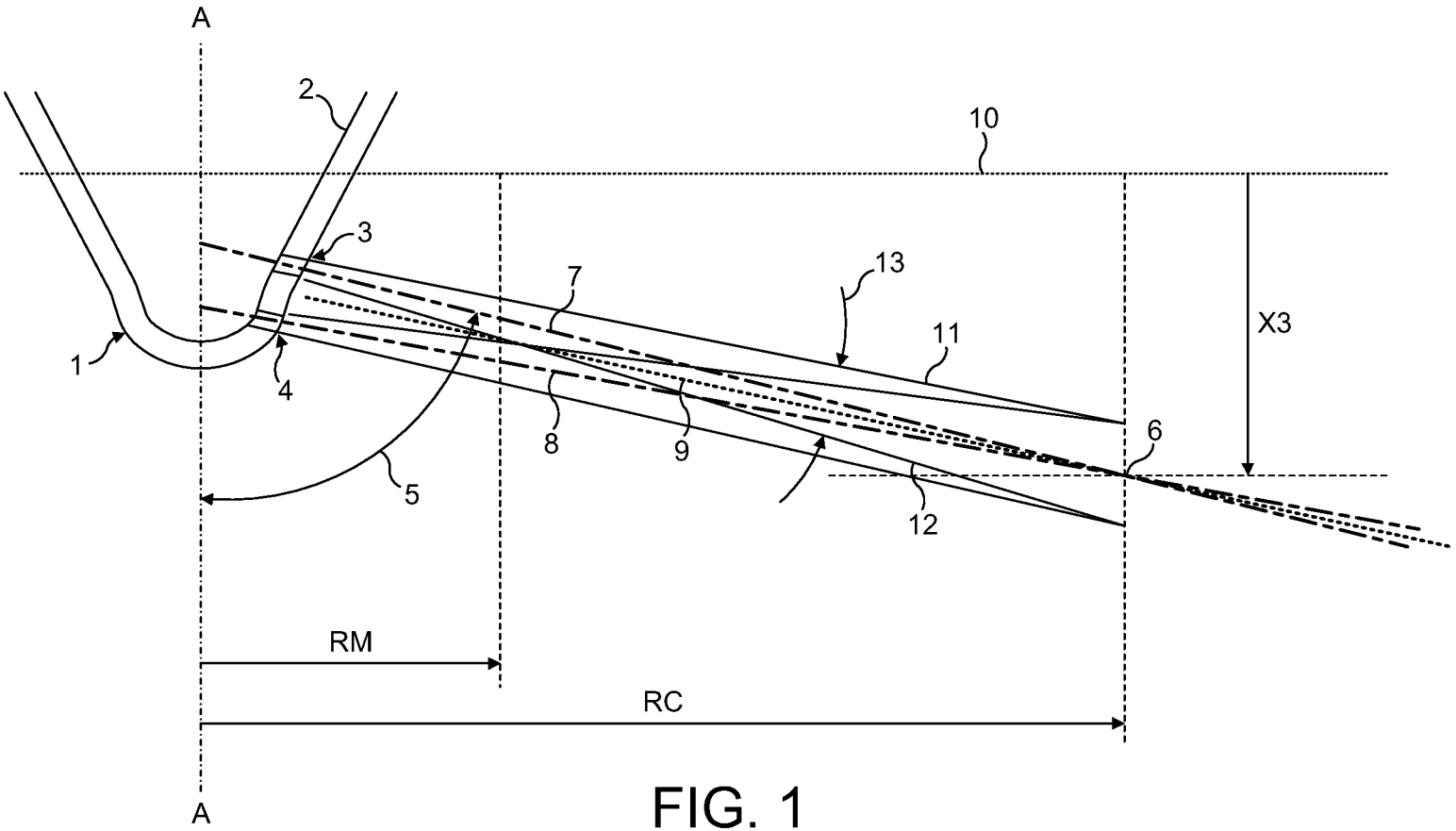
FIG. 1 PRIOR ART
FIG. 1 is a schematic diagram of a conventional fuel injection nozzle.

In the case of the conventional injection nozzle of FIG. 1 there is no way of varying the vertical spray/jet target direction as the engine speed and load are changed. More specifically, in FIG. 1 the angle 5 between the first spray jet axis 7 and the primary nozzle axis A-A is determined by the axis of the upper spray hole 3, which is set during nozzle design and manufacture. Thus, the vertical target distance X3 in the combustion chamber is a compromise, which results in an exhaust smoke level as illustrated in FIG. 2A by S1 at high engine speeds and loads and in FIG. 2B by S2 at low engine speeds and loads. These exhaust smoke values are clearly higher than the minimum possible respective values S3 and S4, as shown in FIGS. 2A and 2B respectively. In this example the soot emission could be reduced with a lower spray jet target in the combustion chamber (higher value of X) at high engine loads and speeds. Conversely, at low loads and speeds the soot emission level could be reduced with a higher fuel spray jet target (lower value of X).

It has been found that the required difference in vertical target position between high engine loads and speeds compared with low engine loads and speeds [absolute value of (X1 minus X2)] is of the order of about 2 mm for a typical diesel engine combustion system.

Furthermore, the upper and lower edges of the fuel spray jet from the upper spray hole 3 of the conventional injection nozzle shown in FIG. 1 are illustrated by the straight lines 11 and 12. A corresponding fuel spray jet included angle 13 is shown. Computer model simulations of the fuel spray jet for typical in-cylinder engine conditions at high load and speed show that the included fuel spray jet angle 13 is about 10 degrees proximal to the nozzle body 2 but can reach about 20 degrees at a radius RC close to the radius of the combustion chamber wall. In reality, the edges 11 and 12 of the fuel spray jet are curved. The increase in the included spray jet angle 13 and the width of the fuel spray jet is caused by the injection of the fuel spray jet into high air density and high ambient air motion in the combustion chamber especially at high engine speed and load conditions.

As stated above, the required maximum variation of the vertical spray jet target as represented by the values X1 and X2 in FIGS. 2A and 2B is of the order of 2 mm for a typical engine combustion system. This corresponds to varying the spray hole axis angle 5 in FIG. 1 by about 5 degrees. This compares with the included spray jet angle 13 of up to 20 degrees for a fuel spray jet from a single spray hole. Also, fuel spray jets that are directed along slightly different directions will tend to merge together owing to the jet entrainment process and the tendency to form a single round circular jet further downstream in the merged jet.

A first embodiment of an injection nozzle according to the present invention, which provides the required variation in the vertical spray jet target will now be described with reference to FIG. 3.

Referring to FIG. 3, the injection nozzle comprises a nozzle body 21 having a blind bore 22. The nozzle body 21 defines a primary nozzle axis A-A which is co-axial with the blind bore 22. The blind end of the bore 22 is provided with upper and lower spray holes 23, 24 and defines a seating with which a valve needle (not shown) is engageable to control the supply of fuel to the upper and lower spray holes or outlet openings 23, 24. The valve needle may be of the type described in U.S. Pat. No. 7,559,488 (the disclosure of which corresponds to European Patent EP-1626173), where an inner valve needle 44 and a concentric outer valve needle 42 are provided and are operable to control the flow of fuel through both the upper and lower spray holes together or through the upper spray hole 23 only. As described in U.S. Pat. No. 7,559,488, the valve needle arrangement depicted in FIG. 3 includes load transmitting means to permit the outer valve needle 42 to transmit a force to the inner valve needle 44 so as to cause movement of the inner valve needle 44 when the outer valve needle is moved beyond a predetermined amount.

As shown in FIG. 3, respective rows of upper and lower spray holes 23, 24 may be provided, each of the holes of the respective rows being located at the same axial position relative to the bore 22. With the same number of spray holes in each of the upper and lower rows, the holes can be arranged so that adjacent pairs of spray holes 23, 24 in the upper and lower rows are directed so that the fuel spray jets merge to form a single fuel spray jet for each pair of spray holes 23, 24 giving the effect of a single large spray hole in terms of fuel mass flow and penetration of the fuel spray jet.

The injection nozzle of the first embodiment is provided with means for permitting the selective injection of fuel through either the upper row of spray holes 23 only, or through both the upper and lower rows of spray holes 23, 24 together, as is known in the art. For example, the means for permitting the selective injection of fuel may comprise a valve needle mounted for reciprocable movement within the bore 22 of the nozzle body 21 and having a construction of that described in EP-1626173.

Accordingly, the injection nozzle is operable such that, at low engine loads and speeds, only the upper row of spray holes 23 is opened. The resulting fuel spray jet has an axis 27 which is determined by the axis of the upper spray hole 23. At the distance RC from the primary nozzle axis A-A, in a direction perpendicular to the axis A-A, the fuel spray jet from the upper spray hole 23 has a vertical target distance X2 below the cylinder head face 30.

In the present embodiment, the distance RC is the radius of the combustion chamber, where the injection nozzle is mounted such that the primary axis A-A of the injection nozzle is coaxial with the primary axis of the combustion chamber. However, the distance RC may be an arbitrary reference distance, such as two thirds of the radius of the combustion chamber measured from the primary nozzle axis A-A. In this case, the reference distance is chosen such that the vertical target distance of the fuel spray jet from the upper spray hole 23 can be distinguished from the vertical target distance of a merged fuel spray jet produced by injection through both upper and lower spray holes 23, 24, as explained in detail below.

For the low load/engine speed operating condition, where fuel is injected through only the upper row of spray holes 23 and the resulting spray jets have a vertical target distance X2, it can be seen from FIG. 2B that this corresponds to the optimum target distance for minimising smoke emissions (S4).

At high engine loads and speeds, the injection nozzle is operable such that fuel is injected through both the upper and lower rows of spray holes 23, 24.

As described above, the same number of spray holes are provided in each row with the adjacent pairs of upper and lower spray holes directed so that the upper and lower fuel sprays merge to form a single spray jet. The edges of the spray jets from each respective pair of upper and lower spray holes 23, 24 start to merge sufficiently at a radius RM so as to form a single fuel spray jet at least towards the outer radii of the combustion chamber, i.e. at the distance RC. The merging of the spray jets is necessary at high engine loads and speeds in order to ensure adequate fuel spray jet penetration into the combustion chamber with the merged spray jet. The upper and lower edges of the merged spray jet are illustrated by the lines 14 and 15.

The lower spray hole axis 28 is significantly below the upper spray hole axis 27 at the radius RC. This means that the effective direction of the merged fuel spray jet is along the axis 29, which gives a vertical target distance X1 below the cylinder head face 30. Accordingly, for the high load/engine speed operating condition, where fuel is injected through both the upper and lower rows of spray holes 23, 24 and the resulting merged spray jet has a vertical target distance X1, it can be seen from FIG. 2A that this corresponds to the optimum target distance for minimising smoke emissions (S3).

Furthermore, if the spray holes 24 of the lower row have the same diameter as the spray holes 23 of the upper row then the axis 29 of the merged spray jet will be midway between the spray hole axes 27 and 28 for the upper and lower spray holes 23, 24.

The difference in the fuel spray jet vertical targets X2 and X1 in FIG. 3 provides the required variation in spray jet vertical target direction between low engine speed and load conditions and high engine load and speed conditions. At the same time the required variation in the effective spray hole diameter as in the prior art is achieved with a change of engine load and speed condition.

Referring to FIG. 4, in a second embodiment of a fuel injection nozzle according to the present invention, the injection nozzle is provided with means for permitting the selective injection of fuel through either the lower row of spray holes 33 only, or through both the upper and lower rows of spray holes 34, 33 together, as is known in the art. For example, the means for permitting the selective injection of fuel may comprise a valve needle arrangement mounted for reciprocable movement within the bore 22 of the nozzle body 21 and having a construction of that described in U.S. Pat. No. 7,063,272 (the disclosure of which corresponds to European Patent EP-1637730), where an inner valve needle 48 and a concentric outer valve needle 46 are provided and are operable to control the flow of fuel through both the upper and lower spray holes together or through the lower spray hole 33 only. As described in U.S. Pat. No. 7,063,272, the valve needle arrangement depicted in FIG. 4 includes load transmitting means to permit the inner valve needle 48 to transmit a force to the outer valve needle 46 so as to cause movement of the outer valve needle 46 when the inner valve needle 48 is moved beyond a predetermined amount. Accordingly, with the second embodiment it is possible to open the lower row of spray holes 33 only at low engine loads and speeds rather than the upper row of spray holes 34 only, as in the first embodiment.

At low engine loads and speeds with only the lower row of spray holes 33 open, the resulting fuel spray jets have a vertical target distance X2 below the cylinder head face 30.

At high engine loads and speeds both the upper and lower rows of spray holes 34, 33 are opened. As explained previously, the same number of spray holes are used in each row with the adjacent pairs of upper and lower spray holes 34, 33 directed so that the upper and lower fuel spray jet edges start to merge sufficiently at a radius RM so as to form a single fuel spray jet towards the outer radii of the combustion chamber, i.e. at the distance RC. The upper and lower edges of the merged spray jet are illustrated by the lines 16 and 17.

At the same time the upper spray hole axis 38 is significantly below the lower spray hole axis 37 at the radius RC. This means that effective direction of the merged fuel spray jet is along the axis 39 and gives a vertical target distance X1 below the cylinder face 30.

If the spray holes 33 of the lower row have the same diameter as the spray holes 34 of the upper row then the axis 39 of the merged spray jet will be midway between the spray hole axes 38 and 37 for the upper and lower spray holes 34, 33.

The difference in the fuel spray jet vertical targets X2 and X1 in FIG. 4 provides the required variation in spray vertical target direction between low engine speed and load conditions and high engine load and speed conditions. Also at the same time the required variation in the effective spray hole diameter as in prior art EP-1059437 is achieved with change of engine load and speed condition.

The invention claimed is:

1. A fuel injection system of an internal combustion engine, including:

a combustion chamber including a chamber ceiling and a chamber wall; and a fuel injector mountable with respect to the combustion chamber for delivering fuel thereto;

the fuel injector including:

a nozzle body having a primary nozzle axis (A-A);

a first outlet opening having a first axis;

a second outlet opening having a second axis; and means for controlling fuel delivery through the first and second outlet openings, said means including an inner valve needle and an outer valve needle, and being operable to permit fuel delivery from only the first outlet opening at relatively low engine loads and speeds, or through both the first and second outlet openings together at relatively high engine loads and speeds, the fuel injector including load transmitting means to permit the valve needle that controls fuel delivery from the first outlet opening to transmit a force to the valve needle that controls fuel delivery from the second outlet opening, so as to cause movement of the valve needle that controls fuel delivery from the second outlet opening when the valve needle that controls fuel delivery from the first outlet opening is moved beyond a predetermined amount;

wherein the first and second outlet openings are oriented such that, in use, when fuel delivery is permitted through only said first outlet opening, a first spray formation is injected along the first axis, the first spray formation reaching a first target distance below said chamber ceiling at a radial distance from the primary nozzle axis; and when fuel delivery is permitted through both openings together, respective first and second spray formations are injected along the respective first and second axes to merge externally of the injector so as to give rise to a combined spray formation having a third axis, the combined spray formation reaching a second target distance below said chamber ceiling at said radial distance from the primary nozzle axis;

wherein said first target distance is less than said second target distance.

2. A fuel injection system according to claim 1, wherein the nozzle body of the fuel injector includes a blind bore, and the first and second outlet openings open into the blind bore at respective locations spaced apart in the direction of the primary nozzle axis.

3. A fuel injection system according to claim 2, wherein the blind bore defines a seating with which each of the inner and outer valve needles is engageable.

4. A fuel injection system according to claim 2, wherein the second outlet opening is disposed between the first outlet opening and the blind end of the bore.

5. A fuel injection system according to claim 4, wherein said outer valve needle is slidable within the bore to control fuel delivery through the first outlet opening and said inner valve needle is slidable within a further bore formed in the outer valve needle to control fuel delivery through the second outlet opening.

6. The fuel injection system as claimed in claim 5, wherein the load transmitting means permits the outer valve needle to transmit a force to the inner valve needle so as to cause movement of the inner valve needle when the outer valve needle is moved beyond a predetermined amount.

7. A fuel injection system according to claim 2, wherein the first outlet opening is disposed between the second outlet opening and the blind end of the bore.

8. A fuel injection system according to claim 7, wherein said first and second axes intersect at an intersection point which lies between the fuel injector and the chamber wall.

9. A fuel injection system according to claim 7, wherein said outer valve needle is slidable within the bore to control fuel delivery through the second outlet opening and said inner valve needle is slidable within a further bore formed in the outer valve needle to control fuel delivery through the first outlet opening.

10. A fuel injection system according to claim 9, wherein the load transmitting means permits the inner valve needle to transmit a force to the outer valve needle so as to cause movement of the outer valve needle when the inner valve needle is moved beyond a predetermined amount.

11. A fuel injection system according to claim 1, the fuel injector including one or more additional adjacent pairs of first and second outlet openings.

12. A fuel injection system according to claim 11, wherein each of said adjacent pairs of first and second outlet openings are radially spaced at regular intervals around the primary nozzle axis.

13. A fuel injection system according to claim 1, wherein said radial distance is substantially equal to the radius of the combustion chamber.

14. A fuel injection system according to claim 1, wherein said first outlet opening and said second outlet opening have substantially the same diameter.

15. A fuel injection system according to claim 4, wherein the first axis and the second axis are non-intersecting between the nozzle body and the chamber wall.

16. A fuel injector mountable with respect to a combustion chamber for delivering fuel thereto, the combustion chamber including a chamber ceiling and a chamber wall, the fuel injector including:

a nozzle body including a blind bore and having a primary nozzle axis;

a first outlet opening having a first axis and opening into the blind bore;

a second outlet opening having a second axis and opening into the blind bore at a location spaced apart from the first outlet opening in the direction of the primary nozzle axis; and means for controlling fuel delivery through the first and second outlet openings, said means including an inner valve needle and an outer valve needle, and being arranged to permit fuel delivery from only the first outlet opening, or through both the first and second outlet openings together, the fuel injector including load transmitting means to permit the valve needle that controls fuel delivery from the first outlet opening to transmit a force to the valve needle that controls fuel delivery from the second outlet opening, so as to cause movement of the valve needle that controls fuel delivery from the second outlet opening when the valve needle that controls fuel delivery from the first outlet opening is moved beyond a predetermined amount;

wherein the first and second outlet openings are oriented such that, in use, when fuel delivery is permitted through only said first outlet opening, a first spray formation is injected along the first axis, the first spray formation reaching a first target distance below said chamber ceiling at a radial distance from the primary nozzle axis; and when fuel delivery is permitted through both openings together, respective first and second spray formations are injected along the respective first and second axes to merge externally of the injector so as to give rise to a combined spray formation having a third axis, the combined spray formation reaching a second target distance below said chamber ceiling at said radial distance from the primary nozzle axis, wherein said first target distance is less than said second target distance;

and wherein the first and second axes are non-intersecting outside the nozzle body.

17. A fuel injector according to claim 16, wherein the second outlet opening is disposed between the first outlet opening and the blind end of the bore.

18. A method for delivering fuel to a combustion chamber of an internal combustion engine, the combustion chamber including a chamber ceiling and a chamber wall, the engine including a fuel injector mountable with respect to the combustion chamber for delivering fuel thereto;

the fuel injector including:

a nozzle body having a primary nozzle axis;

a first outlet opening having a first axis;

a second outlet opening having a second axis; and means for controlling fuel delivery through the first and second outlet openings, the fuel injector including load transmitting means to permit the means for controlling fuel delivery from the first outlet opening to transmit a force to the means for controlling fuel delivery from the second outlet opening, so as to cause movement of the means for controlling fuel delivery from the second outlet opening when the means for controlling fuel delivery from the first outlet opening is moved beyond a predetermined amount;

wherein the first and second outlet openings are oriented such that, in use, when fuel delivery is permitted through only said first outlet opening, a first spray formation is injected along the first axis, the first spray formation reaching a first target distance below said chamber ceiling at a radial distance from the primary nozzle axis; and when fuel delivery is permitted through both openings together, respective first and second spray formations are injected along the respective first and second axes to merge externally of the injector so as to give rise to a combined spray formation having a third axis, the combined spray formation reaching a second target distance below said chamber ceiling at said radial distance from the primary nozzle axis, the first target distance being less than the second target distance;

the method including:

delivering fuel through only the first outlet opening at relatively low engine loads/speeds; and delivering fuel through both the first outlet opening and the second outlet openings together at relatively high engine loads/speeds.

19. A method according to claim 18, wherein said means for controlling fuel delivery through the first and second outlet openings includes an inner valve needle and an outer valve needle; the method including:

lifting one of the inner or outer valve needles so as to deliver fuel through only said first outlet opening at relatively low engine loads/speeds; and lifting both the inner and outer valve needles so as to deliver fuel through both the first and second outlet openings together at relatively high engine loads/speeds.

* * * * *